US005708418A

United States Patent [19]

Ushida et al.

[11] Patent Number: 5,708,418

[45] Date of Patent: Jan. 13, 1998

[54] OPTICAL READING SYSTEM

[75] Inventors: Satoshi Ushida; Junichi Ouchi; Tsutomu Kanno; Hisashi Murata; Kazuo Hasegawa, all of Miyagi-ken, Japan

[73] Assignee: Alps Electric Co., Ltd., Tokyo, Japan

[21] Appl. No.: 614,112

[22] Filed: Mar. 12, 1996

[30] Foreign Application Priority Data

Mar. 28, 1995 [JP] Japan ..... 7-069873

[51] Int. Cl.[6] ..... G08B 13/14

[52] U.S. Cl. ..... 340/568; 340/571; 340/825.32; 235/382

[58] Field of Search ..... 340/568, 685, 340/825.31, 825.32, 825.34, 825.3, 571, 576; 235/380, 382, 382.5

[56] References Cited

U.S. PATENT DOCUMENTS

| | | | |
|---|---|---|---|
| 4,528,444 | 7/1985 | Hara et al. | 235/462 |
| 4,683,462 | 7/1987 | Takeda et al. | 340/571 |
| 5,005,111 | 4/1991 | Teal | 362/156 |
| 5,153,561 | 10/1992 | Johnson | 340/543 |
| 5,412,373 | 5/1995 | Wajda | 340/571 |

FOREIGN PATENT DOCUMENTS 2-213988 8/1990 Japan .

*Primary Examiner*—Jeffery Hofsass
*Assistant Examiner*—Anh La
*Attorney, Agent, or Firm*—Guy W. Shoup; Patrick T. Bever

[57] ABSTRACT

An optical reading system including a warning sound for preventing theft of a portable optical reading apparatus (scanner). A timer is activated when movement of the scanner is detected by a movement detection device mounted on the scanner, indicating that the scanner has been lifted (moved) from a stationary condition. A user determination unit determines whether the movement of the scanner is caused by an authorized user. When the user is an authorized person, a timer is reset. When the timer is not reset during a predetermined time period, a warning sound is generated at a sound level which changes from a low sound level to a loud sound level over a period of time unless a predetermined operation is performed. In one embodiment, a second warning sound is generated at a stationary receiving station when the scanner does not respond to a polling signal.

7 Claims, 10 Drawing Sheets

FROM MAIN ROUTINE
START TIMER
S51
SW OR BC OR ID OR SI?
N
S52
Y
RETURN
S53
Y
POLLING?
N
S54
TRANSMIT SJOn
SOUND BUZZER LOW
S56
S55
Y
≧5 SEC.?
N
SW OR BC OR ID OR SI?
N
S58
S57
Y
RETURN
SOUND BUZZER LOW
S59
Y
≧10 SEC.?
N
BC OR ID OR SI ?
N
S61
S60
Y
RETURN
SOUND BUZZER MEDIUM
S62
Y
≧30 SEC.?
N
ID OR SI?
N
S64
S63
Y
RETURN
SOUND BUZZER LOUD

OPTICAL READING SYSTEM

BACKGROUND OF THE INVENTION

1. Field of the Invention

The present invention relates to an optical reading system, such as a wireless bar code reader.

2. Description of the Related Art

Hitherto, as a method of preventing a wireless bar code reader from being stolen, a method, as disclosed in, for example, Japanese Patent Laid-Open No. 2-213988, has been proposed in which during standby in which bar codes are not being read communications are performed at fixed time intervals between a wireless bar code reader and a bar code receiver, and when a communication during this standby is not accomplished, a buzzer of a wireless bar code reader or the like is made to sound.

However, since in the above-described conventional method a buzzer is made to sound when a communication during this standby is not accomplished between a wireless bar code reader and a bar code receiver, the buzzer is made to sound when the wireless bar code reader is stolen by an unauthorized person, as well as when an authorized user leaves the wireless bar code reader somewhere out of the range of communication with the bar code receiver. Therefore, there is a problem in that this conventional method is rather inconvenient.

A first object of the present invention is to provide an optical reading system which stops a warning by performing a predetermined operation within a predetermined time after a portable optical reading apparatus has been lifted (moved) by an authorized user, thus preventing the portable optical reading apparatus from being stolen, while realizing a theft prevention apparatus convenient for the user.

A second object of the present invention is to provide an optical reading system in which the volume of a warning sound varies according to the degree of difficulty of the operation, thus capable of informing an authorized user of the current state of the portable optical reading apparatus, and capable of preventing the portable optical reading apparatus from being stolen.

A third object of the present invention is to provide an optical reading system in which the portable optical reading apparatus is a wireless apparatus which responds to a polling signal from a fixed station (unit), and which is capable of being applied to a wireless bar code reader.

A fourth object of the present invention is to provide an optical reading system in which both a portable optical reading apparatus and a fixed station give warnings, and which is able to issue a warning even at the place of the fixed station.

A fifth object of the present invention is to provide an optical reading system which gives a warning after a long predetermined time has elapsed when the portable optical reading apparatus has been lifted a second time and which is capable of being prevented from issuing a warning unnecessarily.

A sixth object of the present invention is to provide an optical reading system which stops a warning when a predetermined operation is performed while a warning is being given and which is capable of being prevented from issuing a warning unnecessarily.

The first object can be achieved by first means comprising detecting means for detecting lifting of an optical reading apparatus which has been placed; and warning means for giving a warning when, after it has been detected by the detecting mean that the portable optical reading apparatus has been lifted, a predetermined operation that only an authorized user knows is not performed within a predetermined time.

The second object can be achieved, in the first means, by second means, wherein the predetermined operation involves a plurality of operations which have different degrees of difficulty of operation in relation to time after the lifting of the portable optical reading apparatus by the user, the warning means gives a warning at a low sound level when, after it has been detected by the detecting means that the portable optical reading apparatus has been lifted, neither of the plurality of operations has been performed within the predetermined time, and after the passage of the predetermined time, the warning means gives a warning at a loud sound level when an operation having a high degree of difficulty from among the plurality of operations is not performed.

The third object can be achieved, in one of the first and second means, by third means, wherein the portable optical reading apparatus is a wireless apparatus which responds to a periodic polling signal from a fixed station, and the warning means makes the warning sound louder as the elapsed time during which the polling signal from the fixed station is not received becomes longer.

The fourth object can be achieved, in the third means, by fourth means, wherein both the portable optical reading apparatus and the fixed station give warnings.

The fifth object can be achieved, in one of the first to fourth means, by fifth means, further comprising: second detecting means for detecting that the portable optical reading apparatus has been put in a placed (stationary) state, and the warning means gives a warning after a second predetermined time longer than the predetermined time elapses when it has been detected by the second detecting means that the portable optical reading apparatus has been put in the placed state after the portable optical reading apparatus has been lifted, and further that the portable optical reading apparatus has been lifted.

The sixth object can be achieved, in one of the first to fifth means, by sixth means, wherein the warning means stops a warning when the predetermined operation is performed while a warning is being given.

In the first means, since a warning is given when, after it is detected that the portable optical reading apparatus has been lifted, a predetermined operation that only an authorized user knows is not performed within a predetermined time, a warning is not given by performing the predetermined operation within the predetermined time after the authorized user has lifted the portable optical reading apparatus. Therefore, it is possible to prevent the portable optical reading apparatus from being stolen and to realize a theft prevention apparatus convenient for the user.

In the second means, since a warning is given at a low sound level when neither of a plurality of operations which have different degrees of difficulty of operation in relation to time after the lifting of the portable optical reading apparatus by the user is performed, and a warning is given at a loud sound level when an operation having a high degree of difficulty is not performed after the passage of a predetermined time, the volume of the warning sound varies according to the degree of difficulty of the operation. Therefore, it is possible to inform the authorized user of the current state of the portable optical reading apparatus, and to prevent the portable optical reading apparatus from being stolen.

In the third means, since the portable optical reading apparatus is a wireless apparatus which responds to a periodic polling signal from a fixed station, the portable optical reading apparatus can be applied to a wireless bar code reader.

In the fourth means, since both the portable optical reading apparatus and the fixed station give warnings, it is possible to issue a warning even at the fixed station.

In the fifth means, since a warning is given after the passage of a long predetermined time when the portable optical reading apparatus has been lifted a second time, it is possible to prevent a warning from being issued unnecessarily.

In the sixth means, since a warning is stopped while a warning is being given, it is possible to prevent a warning from being issued unnecessarily.

The above and further objects, aspects and novel features of the invention will become more apparent from the following detailed description when read in connection with the accompanying drawings.

DESCRIPTION OF THE PREFERRED EMBODIMENTS

Preferred embodiments of the present invention will be described below with reference to the accompanying drawings.

Figure 1:
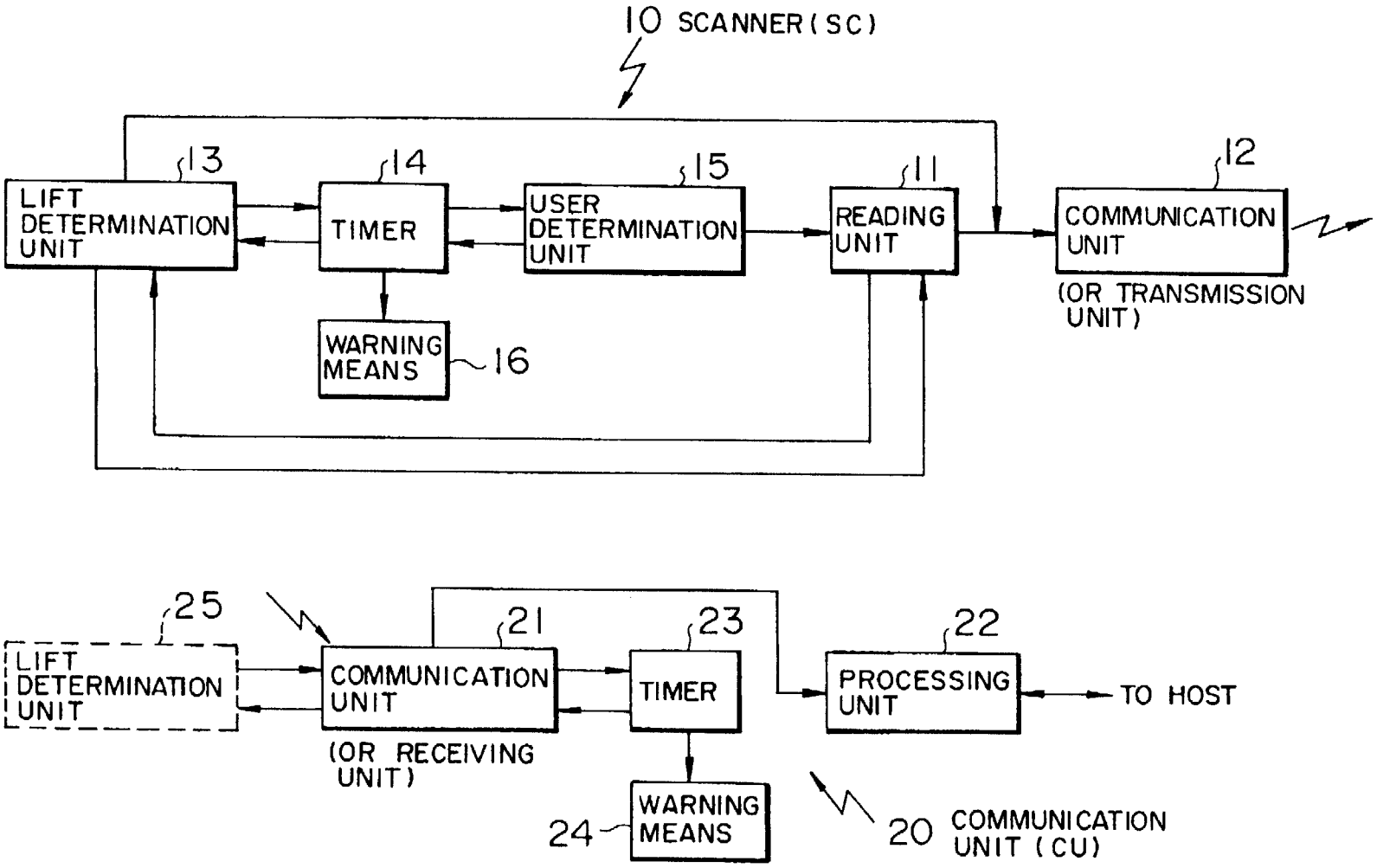
FIG. 1 is a block diagram illustrating a bar code scanner and a communication unit in accordance with a first embodiment of an optical reading system of the present invention.
Figure 2:
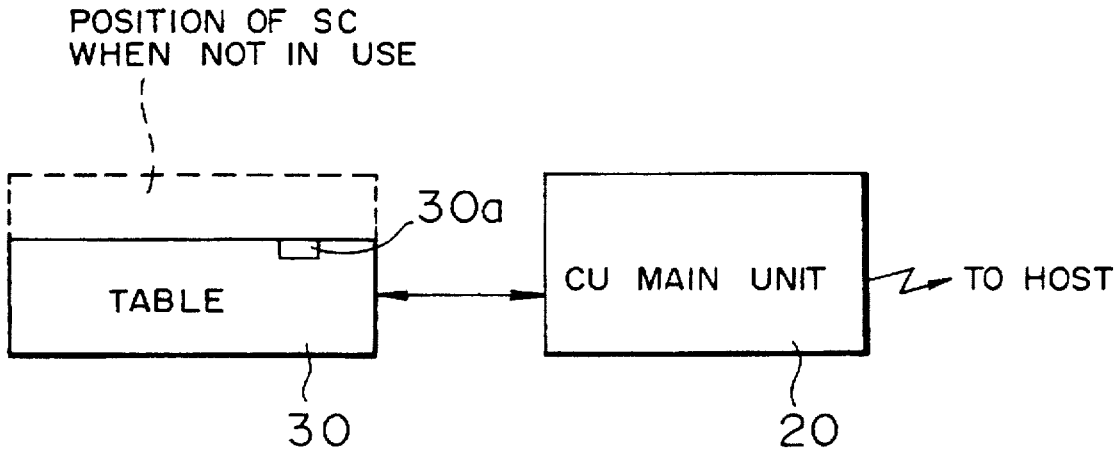
FIG. 2 shows the relationship between a table of the bar code scanner and the communication unit of FIG. 1.
Figure 3:
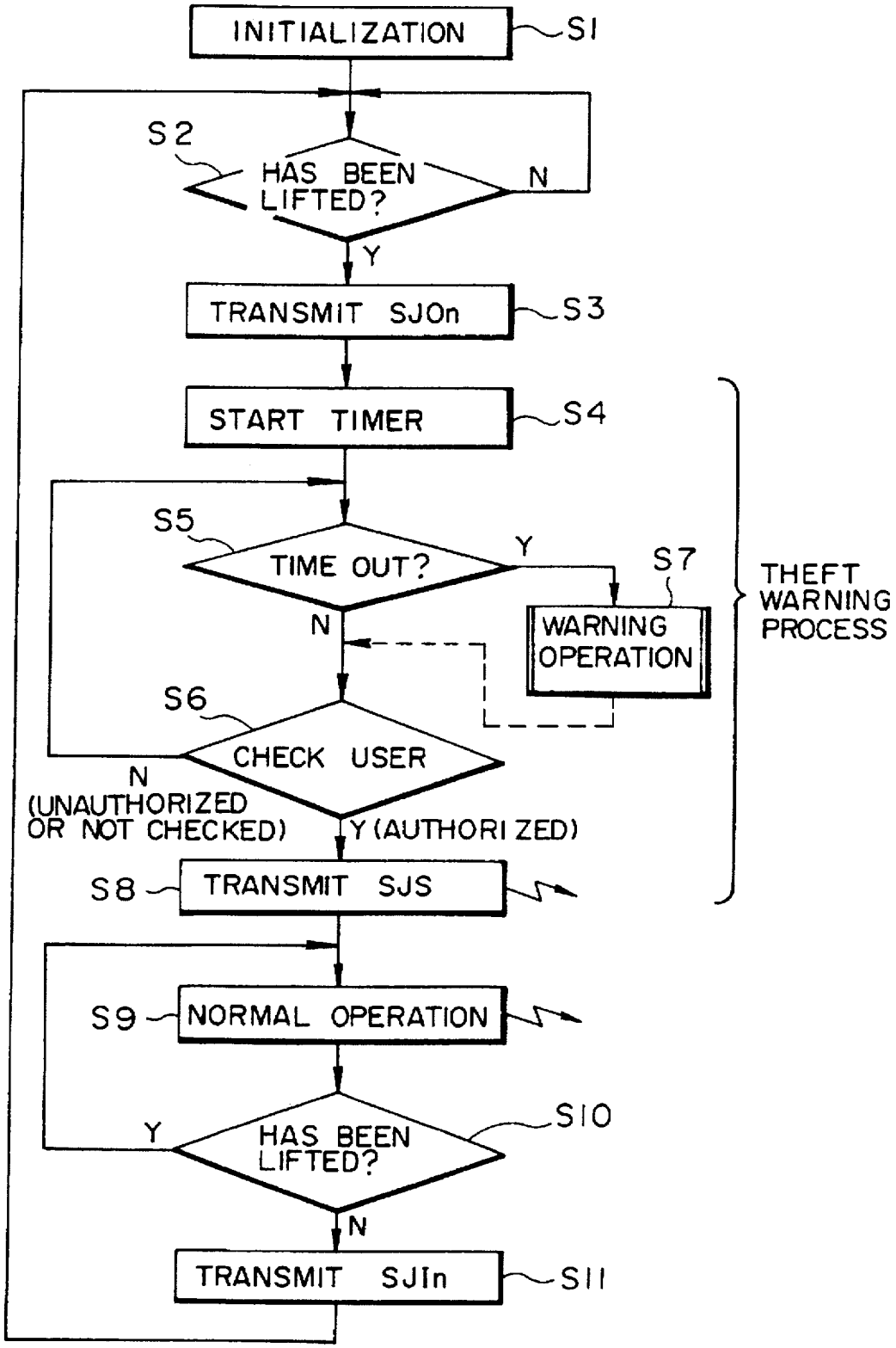
FIG. 3 is a flowchart illustrating the operation of the bar code scanner of FIG. 1.
Figure 4:
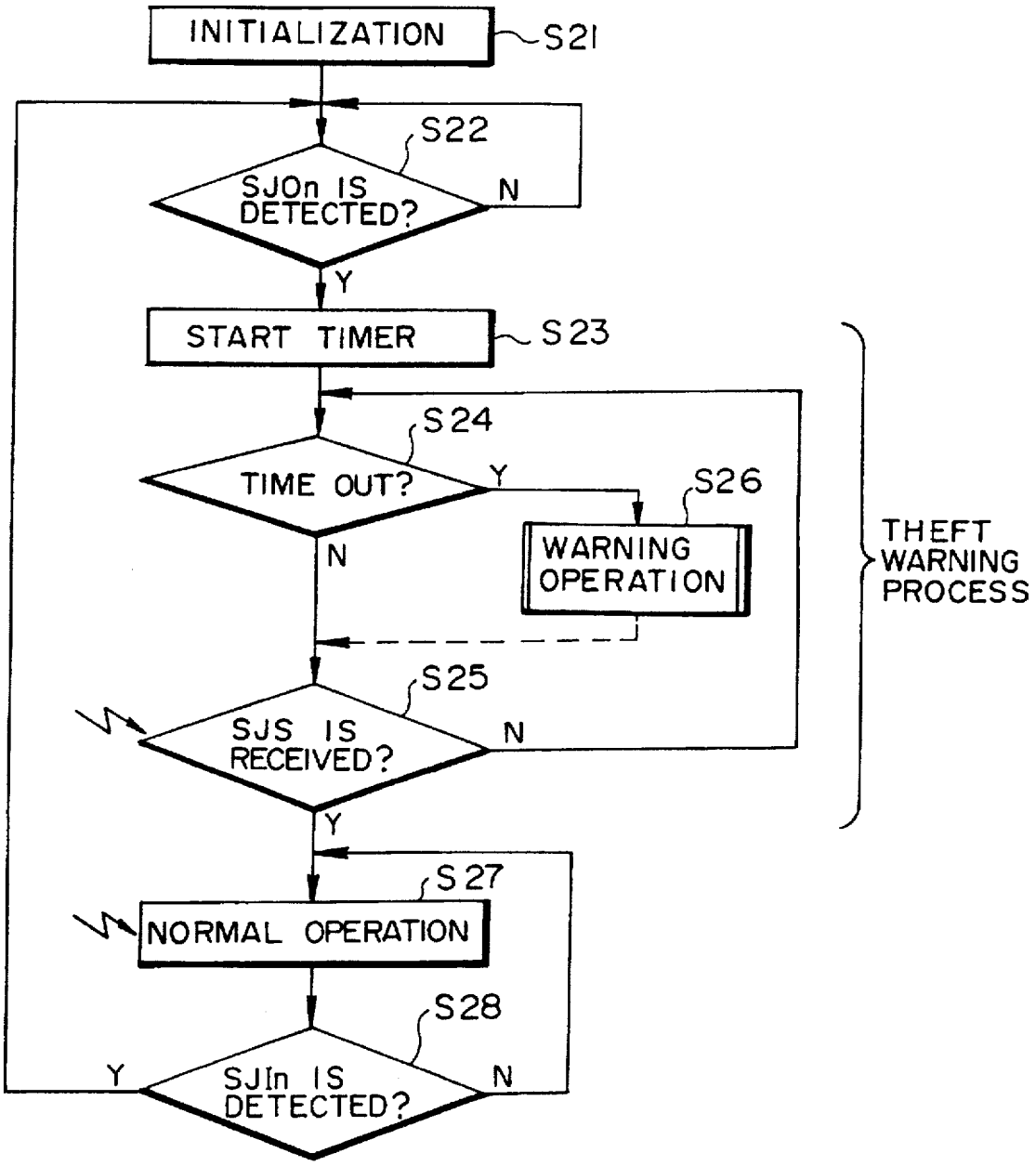
FIG. 4 is a flowchart illustrating the operation of the communication unit of FIG. 1.

FIG. 1 is a block diagram illustrating a bar code scanner and a communication unit in accordance with a first embodiment of an optical reading system of the present invention. FIG. 2 shows the relationship between a table of the bar code scanner and the communication unit of FIG. 1. FIG. 3 is a flowchart illustrating the operation of the bar code scanner of FIG. 1. FIG. 4 is a flowchart illustrating the operation of the communication unit.

Referring to FIG. 1, this bar code reader is roughly constituted of a bar code scanner (SC) 10 which is a mobile unit, and a communication unit (CU) 20 which is a fixed station (unit). Therefore, the SC 10 has the possibility of being stolen. The SC 10 reads bar codes by a read unit 11, modulates the read data by a communication unit 12 and transmits the data to a CU 20 by radio. The CU 20 receives the radio signals transmitted from the SC 10 by a communication unit 21 and demodulates the signals, decodes the demodulated signals by a processing unit 22 and sends the signals to a host (not shown) of a point of-sale (POS) terminal or the like. In this embodiment, the communication unit 12 on the SC 10 may perform only transmission of signals, and the communication unit 21 on the CU 20 may perform only reception of signals.

Next, the construction of theft prevention on the SC 10 will be described in detail.

Initially, a lift determination unit 13 determines if the SC 10 has been lifted (moved) from a placed (stationary) condition. As this determination method, a switch may be provided on the bottom of the housing, or a vibration sensor may be provided inside the housing when the SC 10 is to be placed on the top of a desk. Also, in a case where the SC 10 can be placed on a table (receiver) 30 shown in FIG. 2 and the SC 10 can be charged from the table 30, the SC 10 may be detected via a charging terminal 30*a* serving also as an SC presence detecting terminal. In another example, in the case of FIG. 2, a lift determination unit 25 on the CU 20 may transmit a placed state signal of the SC 10 via wires to the CU 20.

A timer 14 is activated in accordance with the detected signal of the lift determination unit 13. When the timer 14 is not reset by a user determination unit 15 by a predetermined timeout time, warning means 16 is activated. The user determination unit 15 determines whether or not the user of the SC 10 is authorized by detecting if one or more of the following predetermined operations for releasing the warning has been performed.

(1) Whether a reading switch (not shown) (SW) has been pressed a predetermined number of times (e.g., three times)?

(2) Whether any bar codes (BC) have been read?

(3) Whether predetermined bar codes for the user ID (identification) have been read?

(4) Whether, for example, a mat with a person detecting device is disposed at a front door of a shop, and the comings and goings of persons have been detected?

(5) Has an authorized mechanical, wireless key?

Also, in the CU 20, when the communication unit 21 receives a predetermined signal from the SC 10, a timer 23 is activated. When the timer 23 is not reset by a predetermined timeout time, warning means 24 is activated.

Next, a description will be given of the theft prevention operation on the SC 10 with reference to FIG. 3.

This example describes a case in which a plurality of SCs 10 are provided for one CU 20.

Initially, when the main power supply is turned on, initialization is performed (step S1). Then, the lift determination unit 13 monitors whether the SC 10 has been lifted (step S2). When it is determined that the SC 10 has been lifted, the process proceeds to step S3 where a lift detection signal (at the same time a security set signal as well) SJOn, including the ID of that SC 10, is transmitted from the communication unit 12 to the CU 20. SJOn is a signal indicating that the SC 10 has been lifted, and the n at the end is the number (necessary when a plurality of scanners are used) of the scanner. This "transmission" may be either by radio or via wires, and when the table is on the CU 20 side, the transmission may be via wires.

Next, the timer 14 is started (step S4), and then in the loop: step S5→S6→S5, a check is made until the timer 14 times out to determine whether or not the user is authorized. When no authorized user has been detected by the time the timer 14 times out, the warning means 16 is activated (step S7). If, on the other hand, an authorized user has been detected, the process proceeds to step S8 and the subsequent steps.

In step S8 and the subsequent steps, first, a security release signal SJS is sent out to the CU 20 (step S8). Then, in the loop: step S9→S10→S9, normal operations in a state in which the SC 10 has been lifted, that is, reading of bar codes and the transmission of the data, are performed. When it is detected by the lift determination unit 13 in step S10 that the SC 10 has been placed, a signal SJIn indicating that the SC 10 has been placed is transmitted to the CU 20 (step S11), and the process returns to step S2. If the SC 10 has been placed while a warning is being given in step S7, the process may proceed to step S6 where the warning is stopped.

Next, a description will be given of the theft prevention operation on the CU 20 with reference to FIG. 4.

Initially, when the main power supply is turned on, initialization is performed (step S21). Then, a check is made to determine if a lift detection and security set signal SJOn from the SC 10 has been received (step S22). When this signal SJOn is detected, the timer 23 is started (step S23). Then, in the loop: step S24→S25→S24, the security release signal SJS is monitored until the timer 14 times out. This "detection" may be either by radio or via wires, and when the table is on the CU 20, the detection may be via wires.

When the security release signal SJS has not been received by the time the timer 23 times out, the warning means 24 is activated. When, on the other hand, the security release signal SJS has been received, the process proceeds to step S27 and the subsequent steps. In step S27, normal operations, namely, reception of data from the SC 10 and data transfer to the host are performed. When a signal SJIn indicating that the SC 10 has been placed is received in step S28, the process returns to step S22. On the CU 20 side also, when the security release signal SJS is received while a warning is being given in step S26, the process may proceed to step S25 where the warning is stopped.

Next, a second embodiment of the present invention will be described with reference to FIGS. 5 to 8.

Figure 5:
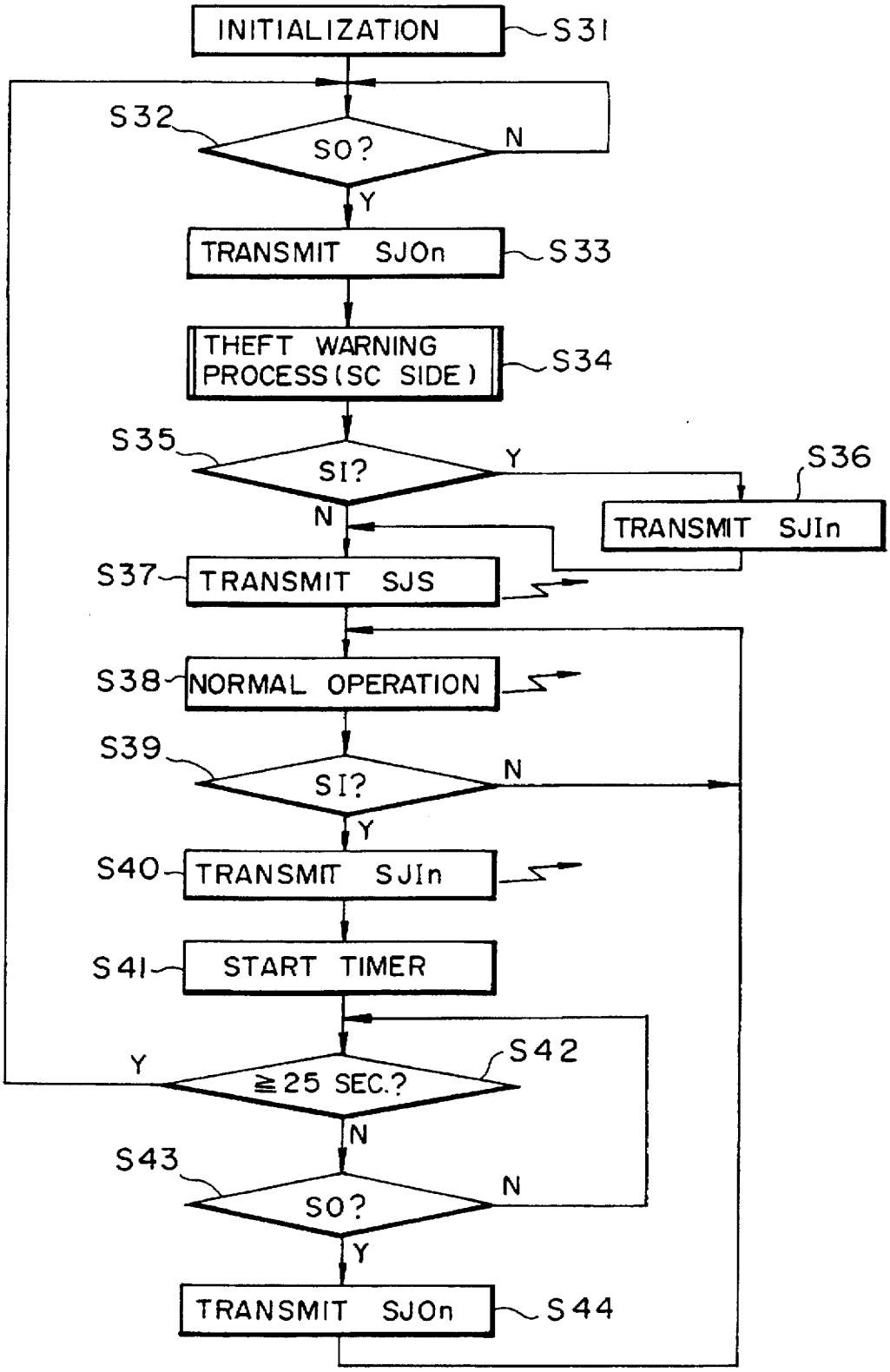
FIG. 5 is a flowchart illustrating the main routine of a bar code scanner in accordance with a second embodiment of the present invention.
Figure 6:
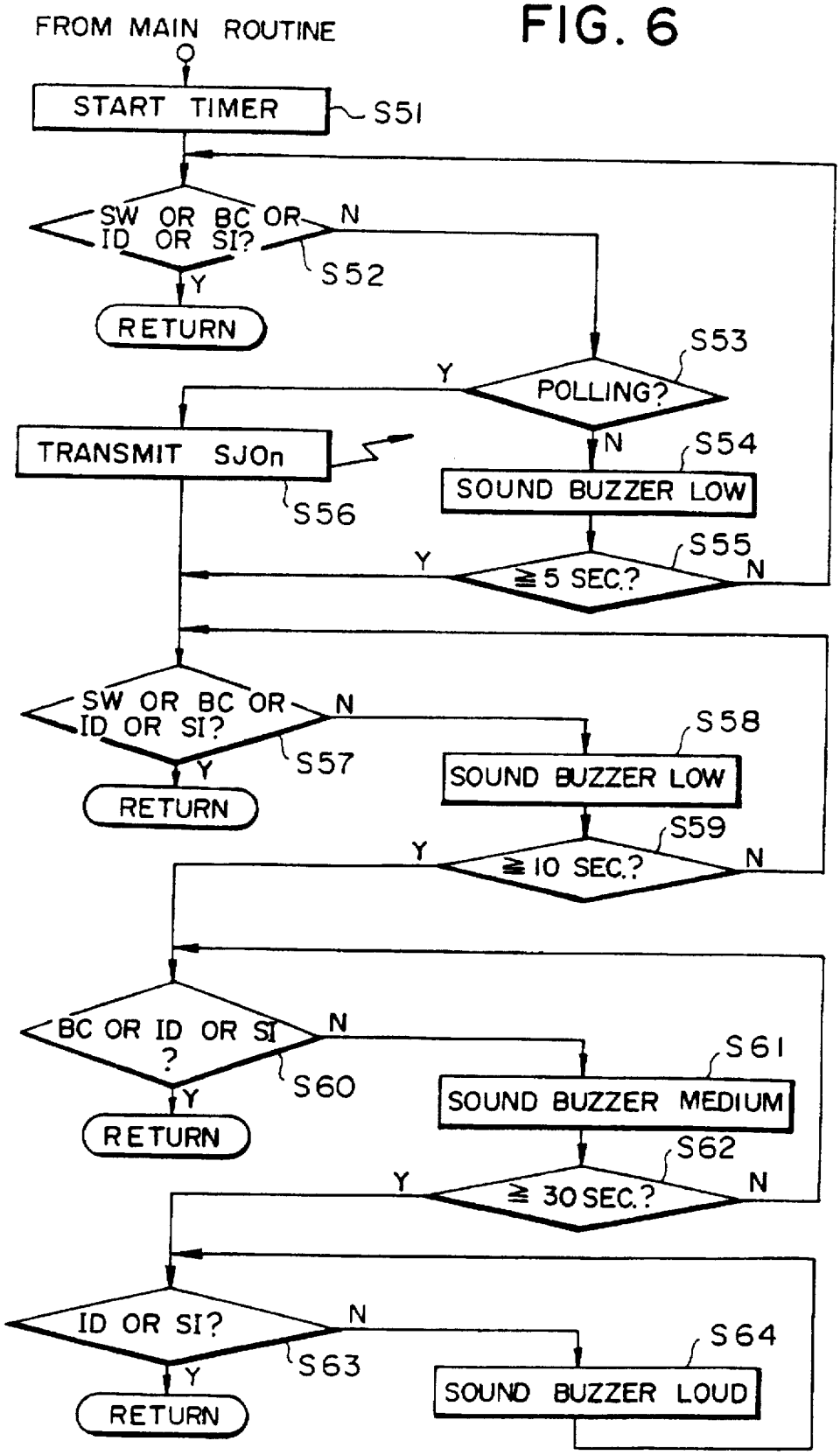
FIG. 6 is a flowchart illustrating in detail a theft warning subroutine of FIG. 5.
Figure 7:
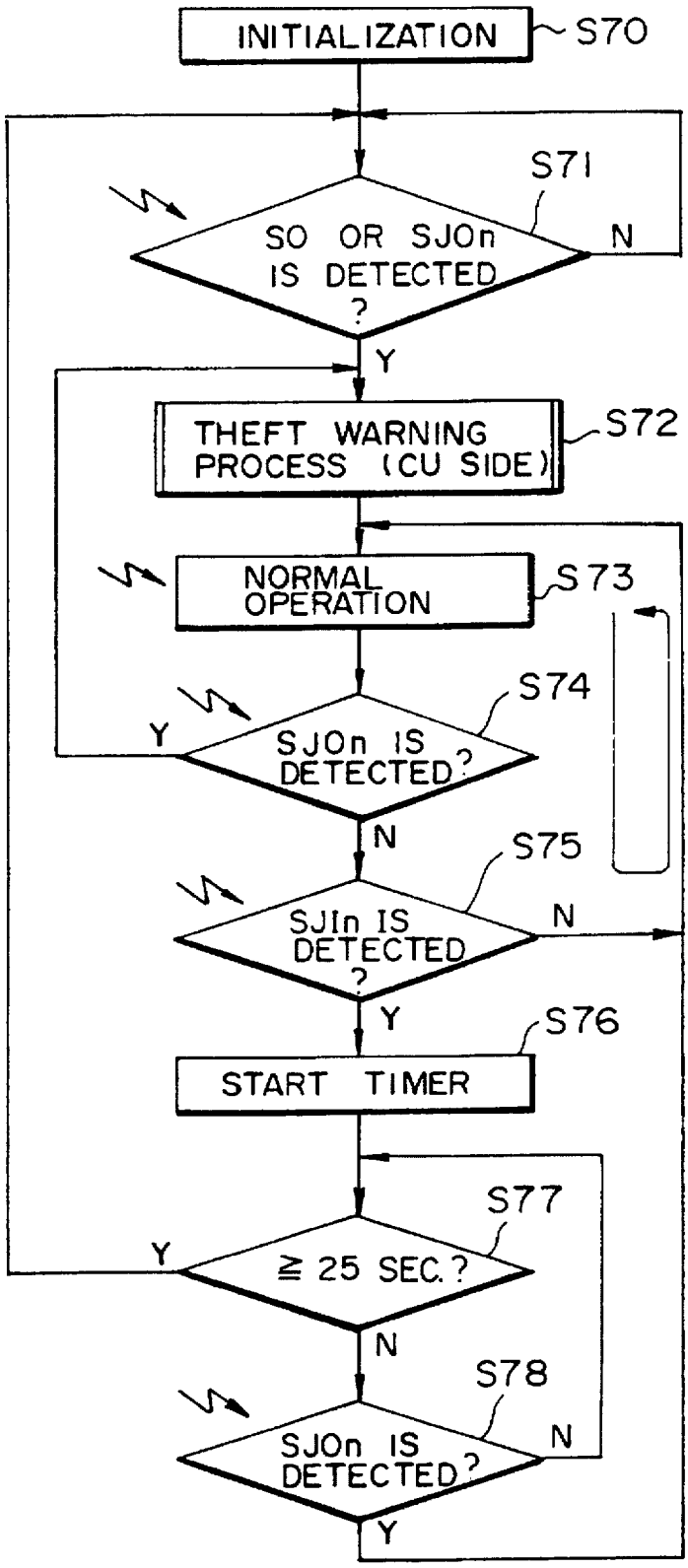
FIG. 7 is a flowchart illustrating the main routine of a communication unit in accordance with a second embodiment of the present invention.
Figure 8:
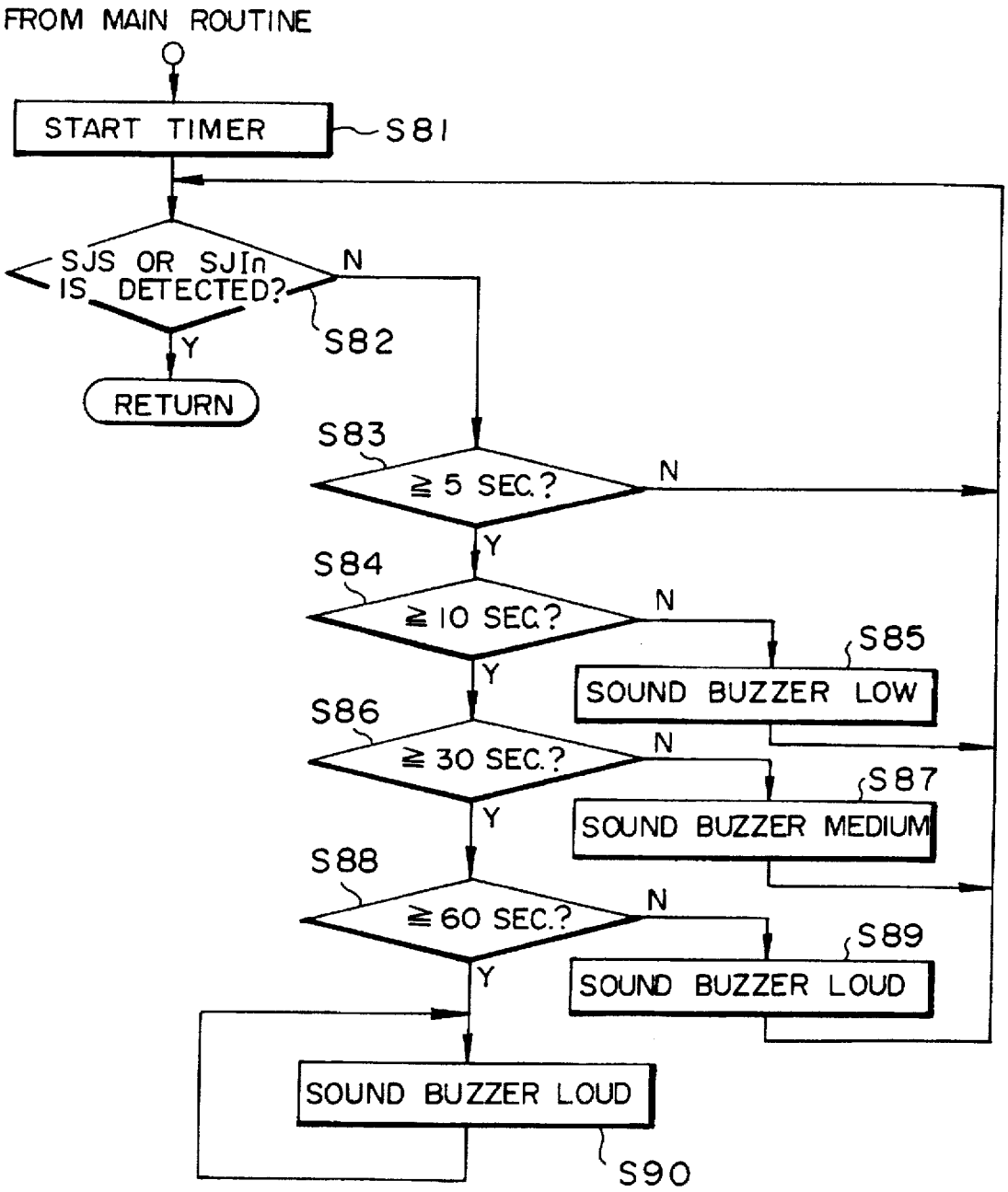
FIG. 8 is a flowchart illustrating in detail a theft warning subroutine of FIGS. 7 and 10.

FIG. 5 shows the main routine of the SC 10. FIG. 6 shows a theft warning subroutine of FIG. 5. FIG. 7 shows the main routine of the CU 20. FIG. 8 shows a theft warning subroutine of FIG. 7.

In this second embodiment, in order to prevent the SC 10 from being stolen, the SC 10 must be placed on the table 30 shown in FIG. 2 when the user is not using the SC 10. The SC 10 needs only to be able to transmit a signal, and the CU 20 needs only to be able to receive a signal. Therefore, the SC 10 and the CU 20 are in a one-to-one correspondence with each other.

During communications between the SC 10 and the CU 20, a polling signal is sent out at intervals of, for example, 100 ms from the CU 20 to the SC 10. Upon receiving the polling signal routed to itself, the SC 10 sends back data. Therefore, when the SC 10 is out of the range of communication with the CU 20, the SC 10 cannot receive the polling signal and cannot sends back data.

Referring to FIG. 5, initially, when the main power supply is turned on, initialization is performed (step S31). Then, a check is made by the lift determination unit 13 to determine if the SC 10 has been lifted (SO: scanner out) from the table 30 (step S32). When the SC 10 has been lifted, the process proceeds to step S33 where a lift detection signal (at the same time a security set signal as well) SJOn is sent out from the communication unit 12 to the CU 20. Then, a theft warning subroutine shown in detail in FIG. 6 is performed (step S34).

Referring to FIG. 6, initially, the timer 14 is started (step S51). In the subsequent step S52, to determine if a predetermined operation that only an authorized user knows has been performed, it is monitored whether the reading switch has been pressed three times within one second (SW?), any bar codes have been read (BC?), predetermined bar codes for the ID of the user have been read (ID?), or the SC 10 has been placed on the table 30 (SI: scanner in).

When the result in step S52 is YES, the process returns to the main routine (step S35) shown in FIG. 5. On the other hand, when the result is NO, the process branches to step S53 and the subsequent steps. In step S53 and the subsequent steps, initially, a check is made to determine if a polling signal has been received from the CU 20 (step S53). When the result is NO, the warning means 16 is activated at a low sound level (step S54).

When five seconds or more have not elapsed on the timer 14 in step S55, the process returns to step S52, and when five seconds or more have elapsed on the timer 14, the process returns to step S57. When the polling signal from the CU 20 has been received in step S53, a lift detection signal (at the same time a security set signal as well) SJOn is sent out (step S56), and the process proceeds to step S57.

In step S57, similarly to step S52, a check is made to determine if an operation that only an authorized user knows has been performed. When the result is YES, the process returns to the main routine (step S35) shown in FIG. 5, and when the result is NO, the process branches to step S58 and the subsequent steps. In step S58 and the subsequent steps, initially, the warning means 16 is activated at a low sound (step S58). Next, when ten seconds or more have not elapsed on the timer 14 in step S59, the process returns to step S57. When, on the other hand, ten seconds or more have elapsed on the timer 14, the process proceeds to step S60.

In step S60, a check is made to determine if any bar codes have been read (BC?), predetermined bar codes for the user ID have been read (ID?), or the SC 10 has been placed on the table 30 (SI), excluding the reading switch operation (SW) within one second. When the result is YES, the process returns to the main routine (step S35) shown in FIG. 5, and when the result is NO, the process branches to step S61 and the subsequent steps.

In step S61 and the subsequent steps, initially, the warning means 16 is activated at a medium sound level (step S61). Then, when 30 seconds or more have not elapsed on the timer 14 in step S62, the process returns to step S60, and when 30 seconds or more have elapsed on the timer 14, the process returns to step S63. In step S63, a check is made to determine if predetermined bar codes for the user ID have been read (ID?), or the SC 10 has been placed on the table 30 (SI), excluding the reading switch operation (SW) within one second and reading of any bar codes (BC?). When the result is YES, the process returns to the main routine (step S35) shown in FIG. 5, and when the result is NO, the process branches to step S64 and the subsequent steps, in which step S64 the warning means 16 is activated at a loud sound, and the process returns to step S630

That is, in the theft prevention processing of FIG. 6, ordinarily it is common that the warning is immediately released (yes in step S52), or if the unit is lifted (from the table in this embodiment) within the communication range, a polling signal is received (yes in step S53). When not so, the buzzer's sound becomes louder with time, and a more stringent releasing procedure becomes required. For example, until about five seconds have elapsed after the SC 10 has been lifted, the warning means 16 sounds at a low sound level even if any one of the plurality of authorized operations is not performed. And, when five seconds have elapsed after the user lifted the SC 10, a low sound level is continued when an operation, excluding the reading switch operation (SW), which is easy to operate, is not performed immediately. Further, when 10 seconds have elapsed, and when an operation, excluding the reading switch operation (SW), which can be performed within that time, is not performed, the buzzer is made to sound at a medium sound level. Then, when 30 seconds have elapsed, and when an operation, excluding the reading switch operation (SW) and the operation of reading any bar codes, is not performed, the buzzer is made to sound at a loud sound level.

Referring back to FIG. 5, when, after the warning is stopped in step S35, the SC 10 has been placed on the table 30 (SI: scanner in), the security release signal SJS is sent out to the CU 20 (step S37), and the process proceeds to step S38. When it is determined in step S35 that the SC 10 has not been placed on the table 30, the process proceeds directly to step S38. In step S38, normal operations, namely, reading of bar codes and transmission of the data, are performed. When it is detected in the subsequent step 39 that the SC 10 has been placed (SI), a signal SJIn indicating that fact is sent out to the CU 20 (step S40).

Next, the timer 14 is restarted (step S41). And, in steps S42 and S43, a check is made to determine if the SC 10 has been lifted (SO) from the table 30 by the time 25 seconds have elapsed on the timer 14. When the result is YES, a lift detection signal (at the same time a security set signal as well) SJOn is sent out (step S44), and the process returns to step S38 where the normal operation is performed. When, on the other hand, the SC 10 has not been lifted from the table 30 by the time 25 seconds have elapsed on the timer 14, the process returns to step 32. That is, the process shown in steps S41 to S42 makes it possible not to perform the security release operation when, after the user has replaced the SC 10 onto the table 30, the user immediately desires to use it a second time.

Next, the operation on the CU 20 side in accordance with a second embodiment of the present invention will be described with reference to FIGS. 7 and 8.

Referring to FIG. 7, initially, when the main power supply is turned on, initialization is performed (step S70). Then, it is monitored whether the lift detection and security set signal SJOn has been received (or, in the case of the construction shown in FIG. 2, whether the SC 10 has been lifted from the table 30) (step S71). When the result is YES, the theft warning subroutine shown in detail in FIG. 8 is performed (step S72).

Referring to FIG. 8, initially, the timer 23 is started (step S81). In the subsequent step 82, a check is made to determine if the security release signal SJS or the signal SJIn indicating that the SC 10 has been placed has been received. When the result is YES, the process returns to the main routine (step S72) shown in FIG. 7, and when the result is NO, on the other hand, the process branches to step S83 and the subsequent steps.

In step S83 and the subsequent steps, in the case of within five seconds, even if the signal SJS or SJIn has not been received, the timer 23 is not made to sound (NO in step S83); in the case of 5 to 10 seconds, the timer 23 is made to sound at a low sound level (steps S84 and S85); in the case of 10 to 30 seconds, the timer 23 is made to sound at a medium sound level (steps S86 and S87); and in the case of 30 to 60 seconds, the timer 23 is made to sound at a loud sound level (steps S88 and S89). In a case in which 60 seconds have elapsed, even if the signal SJS or SJIn has been received, the warning means 24 is made to sound at a loud sound level without being stopped unless a releasing procedure by hardware, such as resetting, is performed (step S90).

Referring back to FIG. 7, in step S73, after the ringing sound of the warning means 24 is stopped, normal operations, that is, reception of data from the SC 10 and transfer of data to the host, are performed. When the lift detection and security set signal SJOn has been received in step S74, the process returns to step S72. When, on the other hand, the signal SJOn has not been received, the process proceeds to step S75. When it is determined in step S75 that the signal SJIn indicating that the SC 10 has been placed has not been received, the process returns to step S73. That is, the loop of steps 73 to S75 involves a process to be performed when bar codes are read in normal times.

When the signal SJIn indicating that the SC 10 has been placed is received in step S75, the timer 23 is restarted (step S76). In steps S77 and S78, it is monitored whether the lift detection signal (at the same time a security set signal as well) SJOn has been received by the time 25 seconds have elapsed on the timer 23. When the result is YES, the process returns to step S73 where a normal operation is performed. When, on the other hand, the signal SJOn has not been received by the time 25 seconds have elapsed on the timer 23, the process returns to step S71. The process shown in S76 and S78 makes it possible not to perform the security release operation when, after the user has replaced the SC 10 onto the table 30, the user immediately desires to use it a second time.

Next, a third embodiment of the present invention will be described with reference to FIGS. 9 and 10.

Figure 9:
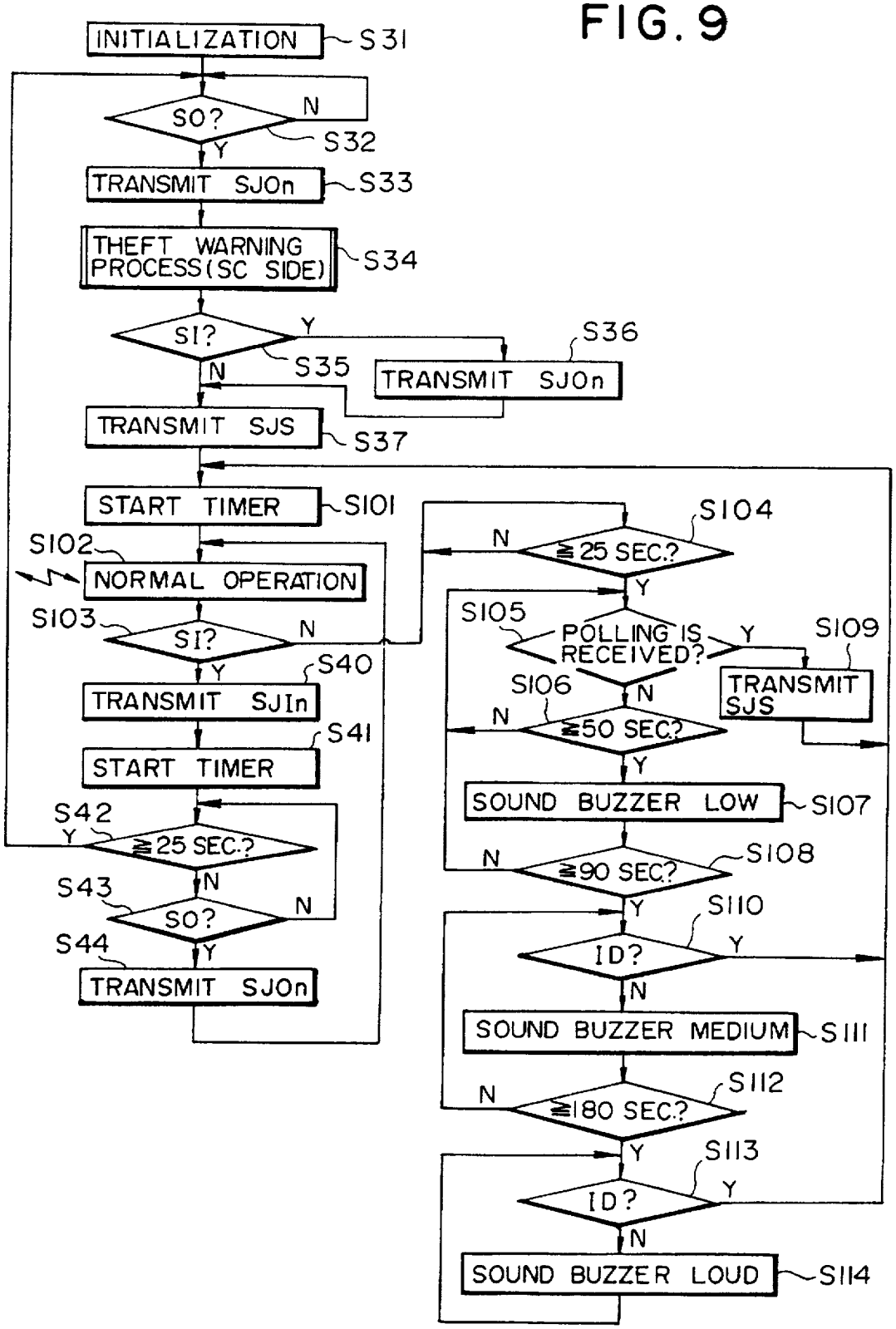
FIG. 9 is a flowchart illustrating the operation of a bar code scanner in accordance with a third embodiment of the present invention.
Figure 10:
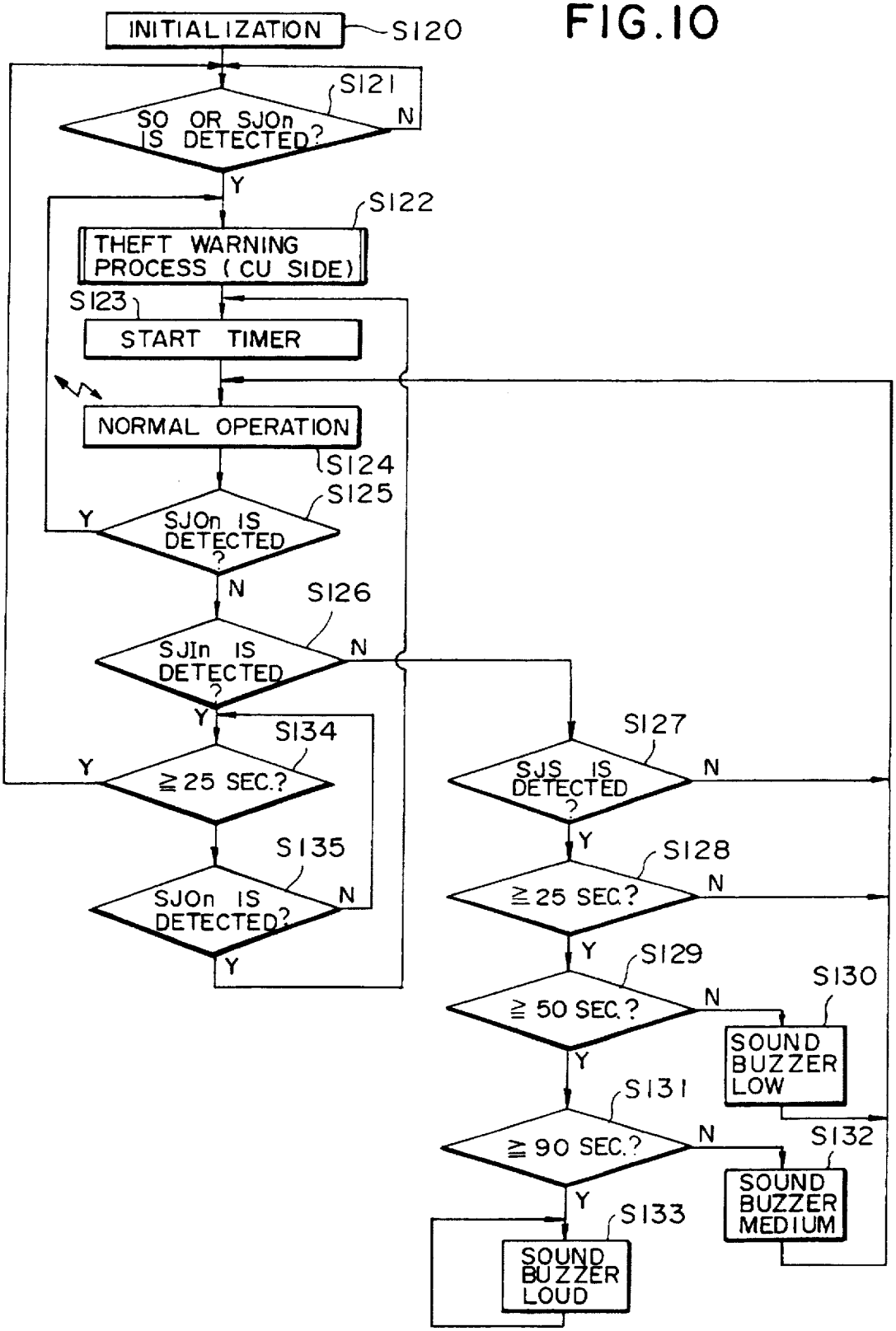
FIG. 10 a flowchart illustrating the operation of a communication unit in accordance with the third embodiment of the present invention.

FIG. 9 is a flowchart illustrating the operation of the bar code scanner in accordance with the third embodiment. FIG. 10 is a flowchart illustrating the operation of the communication unit in accordance with the third embodiment.

In this third embodiment, the table 30 is used, which is constructed in such a way that the user does not need to replace the SC 10 onto the table 30 after the user uses the SC 10 a first time. Both the SC 10 and the CU 20 require transmitting/receiving functions. The SC 10 cannot respond when a polling signal from the CU 20 is not received, that is, when the SC 10 is out of the range of communication with the CU 20.

First, steps S31 and S37 shown in FIG. 9 are the same as those of the above-described second embodiment shown in FIG. 5. Therefore, during the first use of the SC 10, the volume of the ringing sound is varied in the above-described subroutine shown in FIG. 6. In this third embodiment, in normal times, a polling signal is output from the CU 20 side at a short cycle, e.g., 100 ms. In step S101, the timer 14 is started, and the process shifts to the normal operations (step S102). In these normal operations, after the bar codes are read, the SC 10 initiates communications when a polling signal routed to itself has been confirmed. In that case, when the polling signal from the CU 20 is received, the timer 14 is reset and started again (not stopped). When a polling signal has not been confirmed or has not been read, the process proceeds to the next step without taking any action.

And, in step S103, a check is made to determine if the SC 10 has been placed (SI) on the table 30. When the result is NO, the process branches to step S104 and the subsequent steps. When the result is YES, on the other hand, the process proceeds to step S40 and the subsequent steps. Steps S40 and S44 shown in FIG. 9 are the same as those shown in FIG. 5 of the second embodiment. Therefore, when, after the user has replaced the CU 20 on the table 30, the user immediately desires to use it a second time, the security release operation need not be performed.

In step 104 and the subsequent steps, a check is made to determine if 25 seconds have elapsed on the timer 14. When the result is NO, the normal operations are continued. When the result is YES, on the other hand, the process proceeds to step S105 where a check is made to determine if a polling signal has been received. When the result is NO, the process proceeds to step S106. When the result is YES, on the other hand, the security release signal SJS is sent out (step S109), and the process returns to step S101. That is, when 25 seconds of time has elapsed during which the SC 10 has not been replaced onto the table 30, a check is made to determine whether or not the SC 10 is within the range of communication with the CU 20.

In step S106, a check is made to determine if 50 seconds have elapsed on the timer 14. When the result is NO, the process returns to step S105, and thus a check is made again to determine if the SC 10 is within the range of communication with the CU 20. When the result is YES, on the other hand, the process proceeds to step S107 where the warning means 16 is activated at a low sound level. Then, in step S108, a check is made to determine if 90 seconds have elapsed on the timer 14. When the result is NO, the process returns to step S105, and thus a check is made again to determine if the SC 10 is within the range of communication with the CU 20. When the result is YES, on the other hand, the process proceeds to step S110

In step S110, a check is made to determine if predetermined bar codes for the user ID (ID?) have been read. When the result is YES, the process returns to step S101, and when the result is NO, the process proceeds to step S111 where the warning means 16 is activated at a medium sound level. In the subsequent step 112, a check is made to determine if 180 seconds have elapsed on the timer 14. When the result is NO, the process returns to step S110, and when the result is YES, the process proceeds to step S113 where the ID input is checked again. When the result is YES, the process returns to step S101. When the result is NO, on the other hand, the warning means 16 is activated at a loud sound level (step S114). That is, if there is no ID input when the SC 10 is out of the range of communication with the CU 20, the warning sound is made gradually louder.

Next, the operation of the CU 20 in accordance with the third embodiment will be described with reference to FIG. 10.

First, in the same way as in the second embodiment shown in FIG. 7, when the main power supply is turned on, initialization is performed (step S120). Then, a check is made to determine if the lift detection and security set signal SJOn from the SC 10 has been received (or, in the case of the construction shown in FIG. 2, whether the SC 10 has been lifted from the table 30) (step S121). When the result is YES, the theft warning subroutine shown in detail in FIG. 8 is performed (step S122).

Next, the timer 23 is started (step S123), and the normal operation is performed (step S124). In the "normal operation" of the CU 20 in this embodiment, a polling signal is being transmitted. When there is a response to the polling signal, communications are started. In that case, the timer 23 is reset (not stopped). When there is no response, on the other hand, the process proceeds to the next step without taking any action. In the subsequent step 125, a check is made to determine if the lift detection and security set signal SJOn has been received. When the result is YES, the process returns to step S122, and when the result is NO, the process proceeds to step S126 where a check is made to determine if the signal SJIn indicating that the SC 10 has been placed has been received. When the result is YES, the process proceeds to step S134, and when the result is NO, the process proceeds to step S127.

In step S127, a check is made to determine if the security release signal SJS has been received. When the result is YES, the process returns to step S124, and when the result is NO, the process proceeds to step S128 where a check is made to determine if 25 seconds have elapsed on the timer 23. When the result is NO, the process returns to step S123, and when the result is YES, the process proceeds to step S129.

In step S129, a check is made to determine if 50 seconds have elapsed. When the result is NO, a warning is given at a low sound level in step S130, and the process returns to step S124. When the result is YES, on the other hand, the process proceeds to step S131 where a check is made to determine if 90 seconds have elapsed. When the result is NO, a warning is given at a medium sound level in step S132, and the process returns to step S124. When the result is YES, on the other hand, the process proceeds to step S133 where the warning means is made to sound at a loud sound level without being stopped unless a releasing procedure by hardware, such as resetting, is performed.

The above-described embodiment constructed as described above includes detecting means 13 and 25 for detecting lifting of the bar code scanner (SC) 10 which has been placed, and warning means 16 and 24 for giving a warning when, after it is detected by the detecting means 13 and 25 that the bar code scanner (SC) 10 has been lifted, a predetermined operation that only an authorized user knows is not performed within a predetermined time. Therefore, after it is detected that the bar code scanner (SC) 10 has been lifted, a warning is given when a predetermined operation that only an authorized user knows is not performed within a predetermined time. As a result, a warning will not be given by performing a predetermined operation within a predetermined time after the bar code scanner (SC) 10 has been lifted by the authorized user. Therefore, it is possible to prevent the bar code scanner (SC) 10 from being stolen, and to realize a theft prevention apparatus convenient for the user.

In the above-described embodiment, the predetermined operation involves a plurality of operations which have different degrees of difficulty of operation in relation to time after the lifting of the bar code scanner (SC) 10 by the user, the warning means 16 and 24 give a warning at a low sound level when, after it has been detected by the detecting means that the bar code scanner (SC) 10 has been lifted, neither of the plurality of operations has been performed within the predetermined time, and the warning means, after the passage of the predetermined time, gives a warning at a loud sound level when an operation with a high degree of difficulty from among the plurality of operations is not performed, and thus the volume of the warning sound varies in accordance with the degree of difficulty of the operation. Therefore, it is possible to inform the authorized user of the current state of the bar code scanner (SC) 10, and to prevent the bar code scanner (SC) 10 from being stolen. In the above-described embodiment, the bar code scanner (SC) 10 is a wireless apparatus which responds to a periodic polling signal from the communication unit (CU) 20, and the warning means 16 and 24 make the warning sound louder as the time during which a polling signal from a fixed station is not received becomes longer. Therefore, the portable optical reading apparatus can be applied to a wireless bar code reader.

In the above-described embodiment, since both the bar code scanner (SC) 10 and the communication unit (CU) 20 give warnings, it is possible to issue a warning even at the communication unit (CU) 20.

In the above-described embodiment, second detecting means 13 and 25 for detecting that the bar code scanner (SC) 10 is put in a placed state are further provided, and the warning means 16 and 24 give warnings after a lapse of a predetermined time longer than the predetermined time when, after it is detected that the bar code scanner (SC) 10 has been lifted, it is detected by the detecting means 13 and 25 that the bar code scanner (SC) 10 is put in a placed state and further that the bar code scanner (SC) 10 has been lifted. Thus, since a warning is given after a lapse of the long predetermined time when the bar code scanner (SC) 10 has been lifted a second time, it is possible to prevent a warning from being issued unnecessarily.

In the above-described embodiment, since the warning means 16 and 24 stop the warning when a predetermined operation is performed while the warning is being given, it is possible to prevent a warning from being issued unnecessarily.

According to a first aspect of the present invention, since a warning is given when, after it is detected that the portable optical reading apparatus has been lifted, a predetermined operation that only an authorized user knows is not performed within a predetermined time, the warning is stopped by performing the predetermined operation within the predetermined time after the portable optical reading apparatus has been lifted by the authorized user. Therefore, it is possible to prevent the portable optical reading apparatus from being stolen and to realize a theft prevention apparatus convenient for the user.

According to a second aspect of the present invention, since a warning is given at a low sound level when neither of a plurality of operations which have different degrees of difficulty of operation in relation to time after the lifting of the portable optical reading apparatus by the user is performed, and a warning is given at a loud sound level when an operation having a high degree of difficulty is not performed after the passage of a predetermined time, the volume of the warning sound varies in accordance with the degree of difficulty of the operation. Therefore, it is possible to inform the authorized user of the current state of the portable optical reading apparatus, and to prevent the portable optical reading apparatus from being stolen.

According to a third aspect of the present invention, since the portable optical reading apparatus is a wireless apparatus which responds to a polling signal from a fixed station, the portable optical reading apparatus can be applied to a wireless bar code reader.

According to a fourth aspect of the present invention, since both the portable optical reading apparatus and the fixed station give warnings, it is possible to issue a warning even at the fixed station.

According to a fifth aspect of the present invention, since a warning is given after a lapse of a long predetermined time when the portable optical reading apparatus is lifted a second time, a warning can be prevented from being issued unnecessarily.

According to a sixth aspect of the present invention, since the warning is stopped when a predetermined operation is performed while a warning is being given, a warning can be prevented from being issued unnecessarily.

Many different embodiments of the present invention may be constructed without departing from the spirit and scope of the present intention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An optical reading system comprising:

detecting means for detecting movement of a portable optical reading apparatus from a stationary condition; and warning means for generating a warning sound when, after it has been detected by said detecting means that the portable optical reading apparatus has been moved, a predetermined operation is not performed within a predetermined time period;

wherein said predetermined operation involves a plurality of operations which have different degrees of difficulty in relation to time after the lifting movement of the portable optical reading apparatus, said warning means generates a warning sound at a low sound level when, after it has been detected by said detecting means that the portable optical reading apparatus has been moved, none of said plurality of operations has been performed within said predetermined time period, and after the passage of said predetermined time period, said warning means generates a warning sound at a relatively louder sound level when an operation having a relatively high degree of difficulty from among said plurality of operations is not performed.

2. An optical reading system according to claim 1, wherein said warning means stops generating said warning sound when said predetermined operation is performed while said warning sound is being generated.

3. An optical reading system comprising:

detecting means for detecting movement of a portable optical reading apparatus from a stationary condition; and warning means for generating a warning sound when, after it has been detected by said detecting means that the portable optical reading apparatus has been moved, a predetermined operation is not performed within a predetermined time period;

wherein said portable optical reading apparatus is a wireless apparatus which responds to a periodic polling signal from a fixed station, and said warning means generates the warning sound at a progressively louder sound level as an elapsed time during which a polling signal from the fixed station is not received becomes longer.

4. An optical reading system according to claim 3, wherein both said portable optical reading apparatus and said fixed station generate warning sounds.

5. An optical reading system according to claim 3, wherein said warning means stops generating said warning sound when said predetermined operation is performed while said warning sound is being generated.

6. An optical reading system comprising:

first detecting means for detecting movement of a portable optical reading apparatus from a stationary condition;

warning means for generating a warning sound when, after it has been detected by said detecting means that the portable optical reading apparatus has been moved, a predetermined operation is not performed within a first predetermined time period; and second detecting means for detecting movement of the portable optical reading apparatus from the stationary condition, wherein said warning means generates said warning sound after a second predetermined time period, which is longer than said first predetermined time period, is elapsed when it has been detected by said second detecting means that the portable optical reading apparatus has been put in the stationary condition after the portable optical reading apparatus has been moved, and further that the portable optical reading apparatus has been moved.

7. An optical reading system according to claim 6, wherein said warning means stops generating said warning sound when said predetermined operation is performed while said warning sound is being generated.

* * * * *